United States Patent [19]

Masini

[11] Patent Number: 4,772,169

[45] Date of Patent: Sep. 20, 1988

[54] DEVICE FOR PROVIDING SIGNATURE STACKS WITH ENDBOARDS AND FOR THE CONVEYANCE OF SAID STACKS IN STACKERS FOR PRINTING WORKS AND THE LIKE

[75] Inventor: Giancarlo Masini, Galliate, Italy

[73] Assignee: Civiemme S.r.l., Italy

[21] Appl. No.: 900,391

[22] Filed: Aug. 26, 1986

[30] Foreign Application Priority Data

Sep. 10, 1985 [IT] Italy ..... 22104 A/85

[51] Int. Cl.[4] ..... B65B 13/20; B65G 57/10

[52] U.S. Cl. ..... 414/41; 271/171; 414/43; 414/131; 414/753; 414/900; 414/907

[58] Field of Search ..... 271/171, 223; 414/41, 414/43, 113, 131, 753, 900, 907; 53/540, 447

[56] References Cited

U.S. PATENT DOCUMENTS

| | | | |
|---|---|---|---|
| 2,643,619 | 6/1953 | Bonebrake | 414/131 X |
| 2,699,862 | 1/1955 | Walter | 414/131 X |
| 4,554,867 | 11/1985 | Thumm | 414/43 X |

FOREIGN PATENT DOCUMENTS

| | | | |
|---|---|---|---|
| 3040353 | 5/1982 | Fed. Rep. of Germany | 414/131 |
| 20334 | 3/1983 | Italy . | |
| 20345 | 3/1983 | Italy . | |
| 474084 | 5/1951 | Canada | 271/171 |

*Primary Examiner*—Robert J. Spar
*Assistant Examiner*—Janice Krizek
*Attorney, Agent, or Firm*—Kirschstein, Kirschstein, Ottinger & Israel

[57] ABSTRACT

A device for providing signature stacks (12) with endboards (11) and for conveying the stacks (12) from a stack-forming position wherein such stacks are formed to the signature-pressing station (7), comprising a single endboard storage unit (10) fitted with a mobile wall (13) and with a charging unit (18) featuring a mobile cursor (23) designed to effect to-and-fro strokes of varying lengths, so that endboards (11) for signatures of all types and sizes may be loaded. The device further comprises a slide (41) for conveying the stacks (12), designed to run between a first limit stop position corresponding to the above stack-forming position and a second limit stop position corresponding to the stack (12) pressing or binding station. The travelling slide (41) is equipped with articulated side panels (51), so that stacks (12) made with signatures of any size whatever may be transferred from one location to the other.

7 Claims, 6 Drawing Sheets

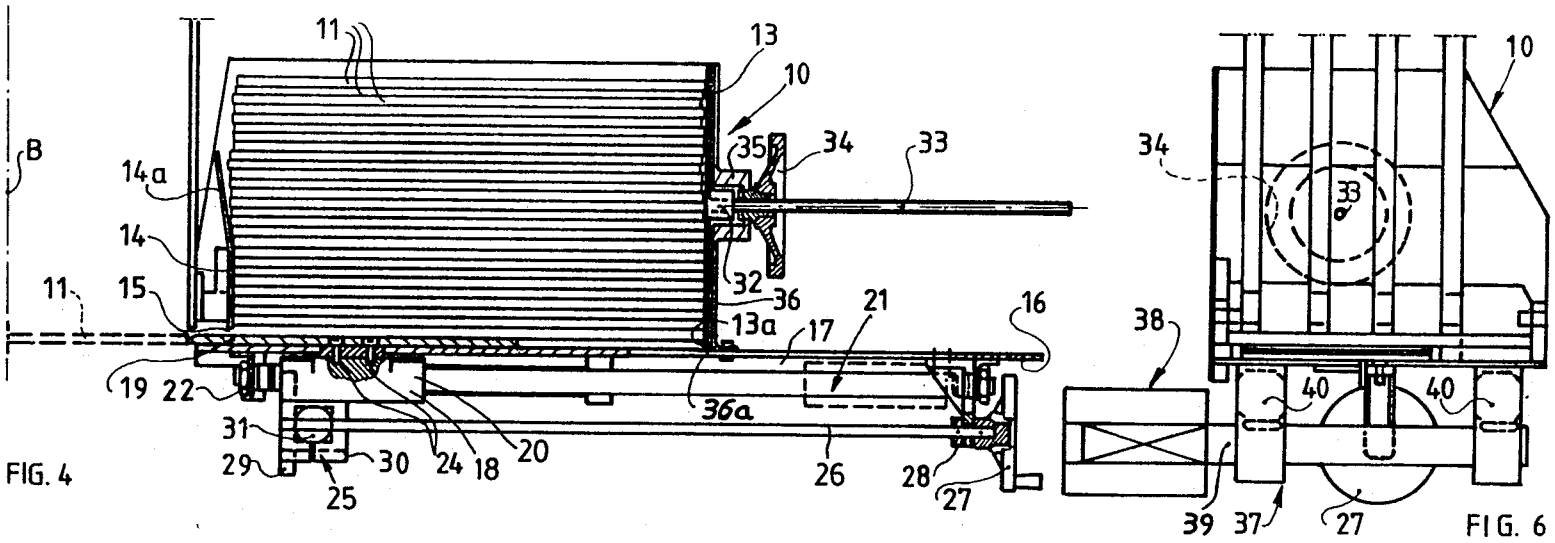
10
33
34
38
39
37
40
40
27
FIG. 6
13
10
35
34
33
32
36
13a
36a
17
21
16
26
28
27
11
14a
14
15
19
22
29
31
25
30
24
18
20
11
B
FIG. 4
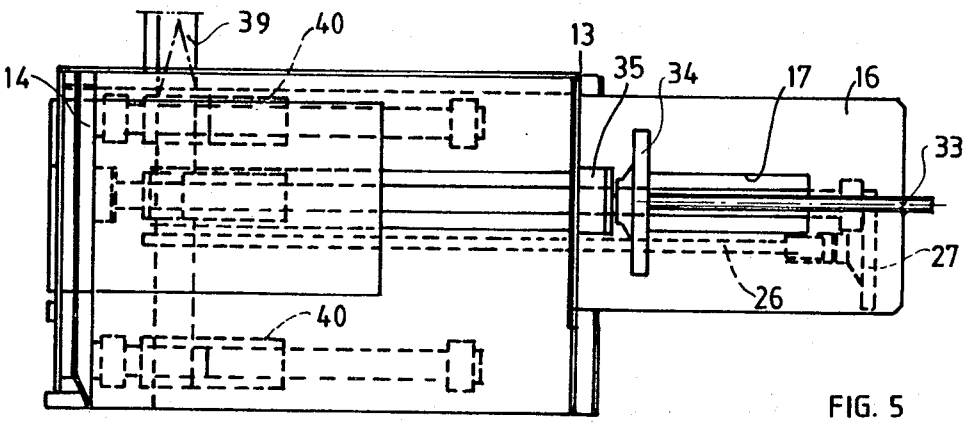
33
27
16
17
26
34
35
13
40
39
40
14
FIG. 5

DEVICE FOR PROVIDING SIGNATURE STACKS WITH ENDBOARDS AND FOR THE CONVEYANCE OF SAID STACKS IN STACKERS FOR PRINTING WORKS AND THE LIKE

BACKGROUND OF THE INVENTION

1. Field of the Invention

This invention relates to a device for providing signature stacks with endboards and for conveying said stacks in stackers for printing works and the like.

2. Description of Related Art

Signature-stacking, as performed in printing works and the like by means of conventional stackers, normally require that special boards be placed at the respective ends of the stacks once they are completed, the function of such boards being that of preventing the signatures placed at the ends of said stacks from suffering damage as may be caused by pressing rams and binding straps when tamping, or pressing, and binding said stacks. Such damage, in fact, normally results from the exceedingly high pressure exerted on the stacks—in the region of e.g. 600 kgs—during binding.

Such boards are generally placed manually by an operator. While the incoming signatures are carried by the swing plate, the fork of the lift truck is raised to its uppermost position; hence a first board is placed by the operator, which thus becomes the bottom endboard. Then the swing plate is lowered and the formed part of the stack is placed onto said endboard, after which the plate is retracted and raised while more signatures are loaded on to the fork. The process is carried on until the desired stack height is achieved, at which point the operator places a second endboard at the top of the stack, namely, the top endboard. Hence the fork places the full stack onto the roller unit defining the bottom of the stack-forming shaft, which is designed to convey the stack toward the binding station. As the stack is placed on the bottom of the stacker, another manual operation must be performed, in that the operator must see to the effective conveyance of the stack from said stack-forming shaft to the binding station. The stack is supported by the roller bottom and rests against the stacker roller board. Conveyance is effected as follows: the operator places one hand onto the top endboard and with his other hand exerts pressure on the stack in order to drive it along the conveyance track. As the stack reaches the binding station, two rollers are lifted out of the roller board and pressed against the sides of the stack so as to keep it in the required position during pressing of same. These rollers, therefore, act as mobile side members. Pressing is normally effected by means of two adjacent vertical cylinder-ram units, whereas binding is carried out by means of a conventional skein-winder, employing e.g. thermoplastic straps.

Where conventional stackers are employed, an operator is needed also in order to prevent the stack from hollowing out on one side and bulging on the other when the stack itself is being lowered (this defect is commonly referred to as a "banana-shaped stack" and is particularly likely to occur where the signatures are folded in-and-in); for otherwise the stack would most probably collapse as soon as it is left loose or placed onto the conveyor. In order to prevent this from happening, the operator places one hand onto the top end of the stack and uses his free hand to correct any misalignment. Where conventional stackers are used, therefore, the operator must perform three functions, namely:

1. place the boards at the ends of the stacks;
2. check, and if necessary see, that the stacks are kept in the upright position after loading them onto the roller bottom of the stacker; and
3. push to stacks along the conveyance path leading from the stack-forming shaft to the binding station.

The applicant has already submitted two designs (Italian Patent Application Ser. Nos. 20344 A/83 and 20345 A/83) relating to an automatic endboard-feeding device for endboards produced in just one size; these designs, however, require the use of two loaders and imply a considerable amount of circuitry. In addition, these loaders are designed to operate with endboards of a definite size, hence are unable to meet the varying operating requirements dictated by signatures of different sizes. These designs feature, furthermore, a stack-conveying device, which in turn implies considerable construction costs, besides depending for its operation on a definite signature size.

SUMMARY OF THE INVENTION

1. Objects of the Invention

It is a major object of this invention to provide a device of the aforementioned type, which may be capable of performing the three functions referred to hereinabove in a fully automatic way, the device being based on a reasonably simple constructive concept and ensuring operational effectiveness. A further object of this invention is to provide a device of the aforementioned type, which may be operated as a fully automatic universal type, namely one which may be used for signatures produced in any given size.

2. Features of the Invention

These as well as other objects are achieved, according to the invention, with a device for providing signature stacks with endboards and for conveying said stacks in stackers for printing works and the like, comprising:

i. an endboard storage box, fixed to the frame of the stacker and equipped with a mobile wall, with a guiding wall placed opposite said mobile wall and with a longitudinally slotted bottom plate, the mobile wall, the thereto adjacent stationary wall and the above-mentioned guiding wall being supplied with a number of slits for the passage of said endboards, or of a thrust-bar, ii. an endboard charging unit, connected with said storage box and comprising a plate cursor moving to-and-fro on the bottom of the endboard storage box and related to the mobile member of a driving cylinder/ram unit fitted under said storage unit, the mobile member of said cylinder/ram unit being furthermore connected with some members specially designed to vary the position of said mobile member with respect to the charging cylinder/ram unit, so that the plate cursor may effect strokes of varying lengths while the length of stroke of the cylinder/ram unit is kept constant, iii. a slide featuring two side panels for positioning the stacks sideways and conveying same, said side panels being adjustable and fitted as tilting members onto said slide, the latter running on guides placed facing the stacker roller board and parallel thereto from a first limit stop position, wherein the side panels stand in the stack-forming shaft, to a second limit stop position, wherein the side panels stand in the binding station, suitable driving units designed to control the tilting motion of the side panels and suitable conveyance units for operating said side panel-supporting slide being provided.

According to the invention, the guiding wall of the endboard storage box is provided with a raking sector for sliding and positioning the endboards, while the middle portion of the mobile wall is provided with an outwardly projecting lug housing a freely-revolving though axially-fixed threaded rod designed to engage a control wheel, said wheel being supported in a freely-revolving though axially-fixed fashion in a box-like housing designed as an integral member of the stationary wall of the storage unit adjoining the mobile wall, and housing in same the aforementioned projecting lug fitted in the middle portion of the mobile wall.

In the device according to the invention, said members specially designed to vary the length of stroke of the mobile member of the endboard-delivering cylinder/ram unit consist, essentially, of a freely revolving though axially stationary threaded bar which is housed at one end in a plate supported by the bottom of the storage unit and, at the other end, in a plate designed as an integral member of said mobile part of the cylinder/-ram unit, said threaded bar running across a core acting as a nut screw and fitted in a housing secured to said supporting plate and to said outer cursor member, said threaded bar being connected with a control wheel.

According to the invention, the endboard storage unit is desirably provided with a rest whereby it may be fitted onto the stacker frame.

Each of the side panels of the stack-conveying slide is advantageously provided with two arm set facing one another and carried by one and the same shaft, the top and bottom portions of which are provided with a sprocket wheel, the upper and lower sprocket wheels each driving a chain leading to a cylinder-ram driving unit, the upper cylinder/ram unit controlling the oscillation of the side panels in one direction and the lower cylinder/ram unit controlling the rotation of the side panels in the opposite direction, whereby said side panels may be opened and closed.

Each of the side panels is equipped with a top arm and a bottom arm, which carry two crosspieces at right angles with respect to said arms.

Moreover, each side panel is desirably articulated, hence the narrower stacks of signatures can be gripped with the portion thereof which is furthest from the supporting bars.

According to the invention, two opposite pilot bars are fitted onto the casing of the stacker by means of rigid stands, and the slide conveyance members include a chain drive unit engaging two wheels, one of which is carried as a freely-rotating member by one of said pilot bar stands which are integral parts of the stacker casing, while the other is connected to a geared-motor unit, said chain being provided with a plate specially designed to secure the chain itself to a crosspiece which is integrally connected to said conveyance slide or trolley.

With the device according to the invention, several important advantages are obtained. For one thing, the signature-stacking cycle is fully automated, which means that the work can be performed without the constant supervision of an operator, who may therefore be employed for different purposes. Secondly, once the device is installed onto the stacker, signature stacks in any desired size may be obtained, e.g. A4, A3, A5 single or double, magazine, tabloid, digest, double digest or any other commercial size. Signature size can be varied by simply adjusting the endboard charging unit as required - a simple operation, which can be effected quickly and without any difficulty. The device features an extremely small number of components, and the operating cycle may be fully automated by using relatively simple, highly reliable circuits.

A further advantage is that the device itself can be mounted onto any currently-employed stacker without difficulty, hence the whole stacking cycle may be automated even where conventional standing or raking stackers are used, with a conveyor track leading from the stacking shaft to the binding station.

BRIEF DESCRIPTION OF THE DRAWINGS

Further features, advantages, and details of the device according to the invention will become apparent from the following description of a preferred, though by no means restrictive, embodiment of the device, to be considered in conjunction with the hereto enclosed drawings.

In said schematic drawings:

FIG. 4 is a longitudinal median section across the endboard storage box according to the invention, taken along line IV—IV in FIG. 1;

FIG. 5 is a top view of the endboard storage box shown in FIG. 4;

FIG. 6 is a side view of the endboard storage box according to FIG. 4;

DESCRIPTION OF THE PREFERRED EMBODIMENT

Figure 1:
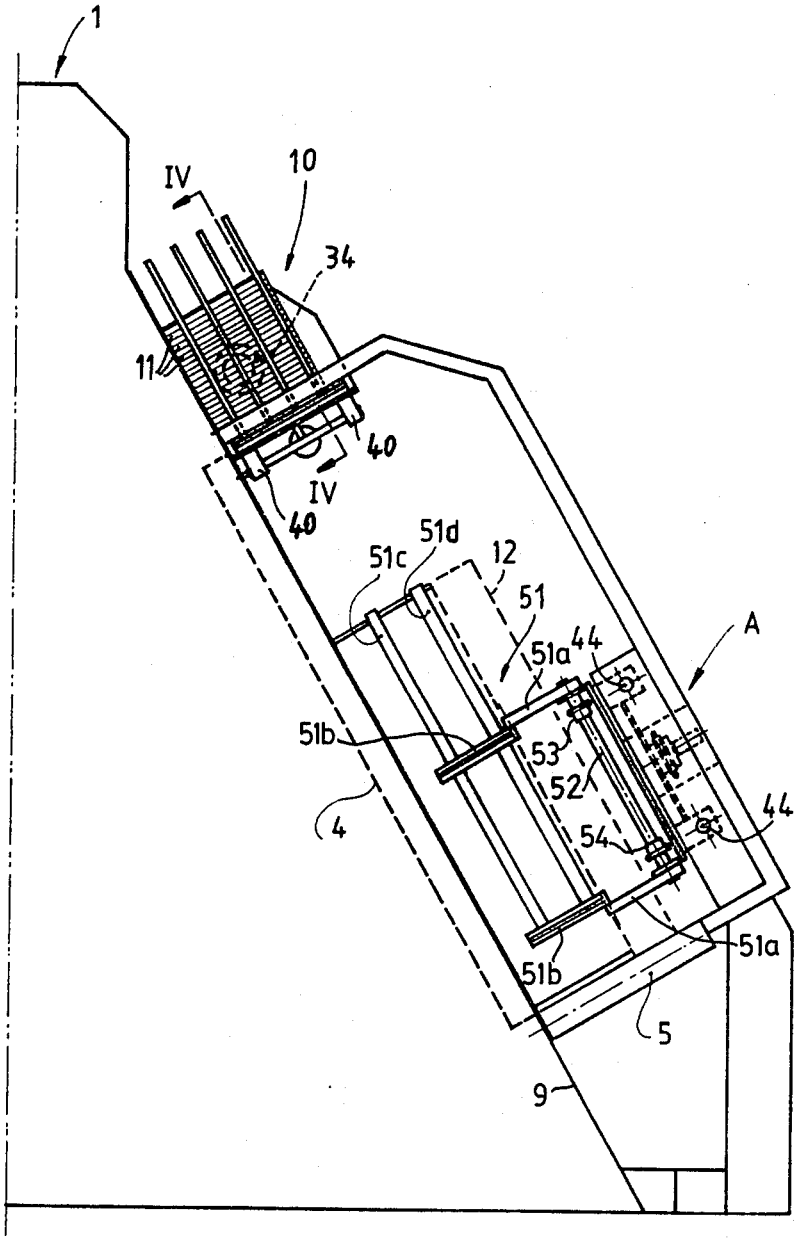
FIG. 1 is a side elevational scrap view of a conventional signature stacker equipped with the device according to the invention.
Figure 2:
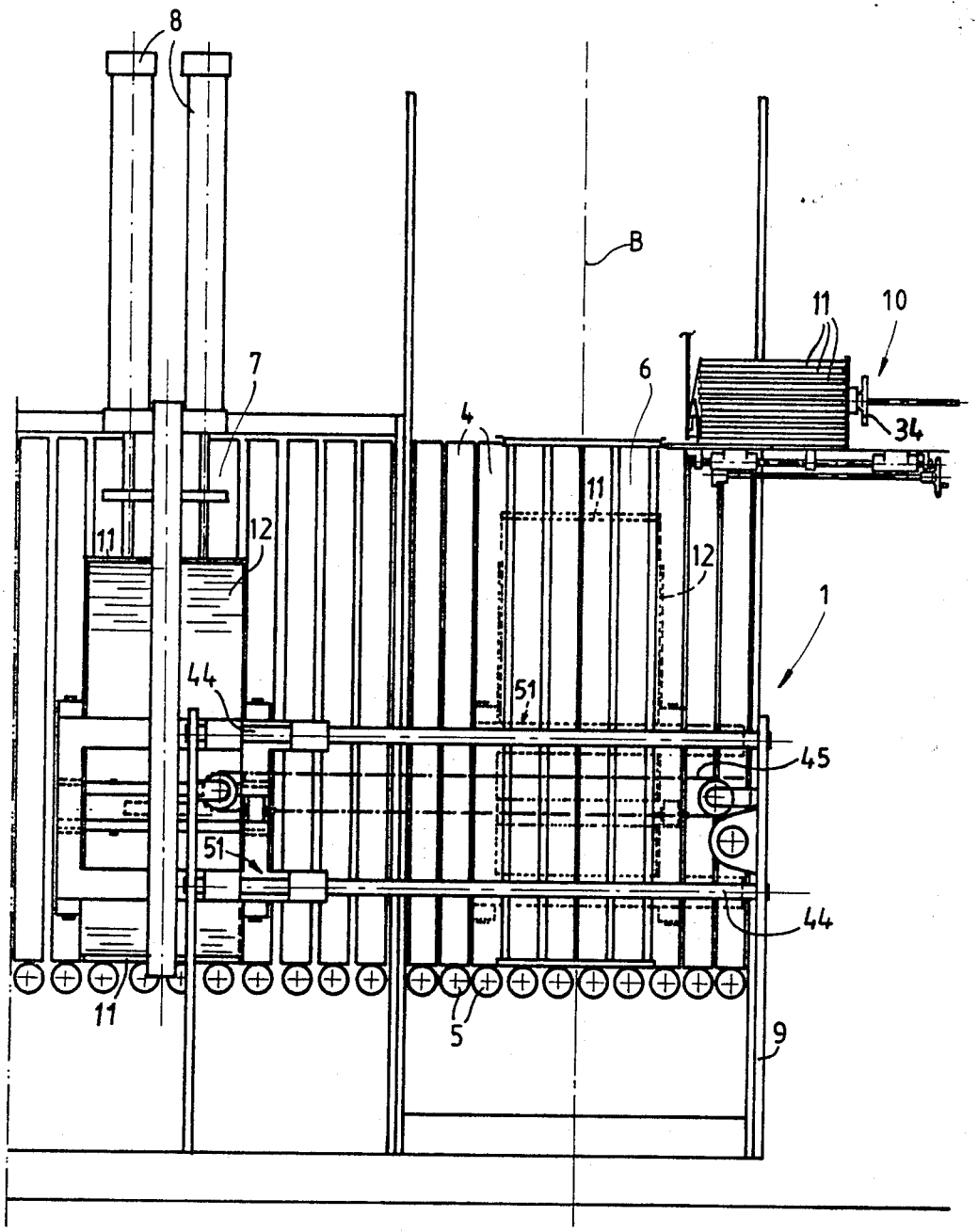
FIG. 2 is a front elevation of the stacker shown in FIG. 1.
Figure 3:
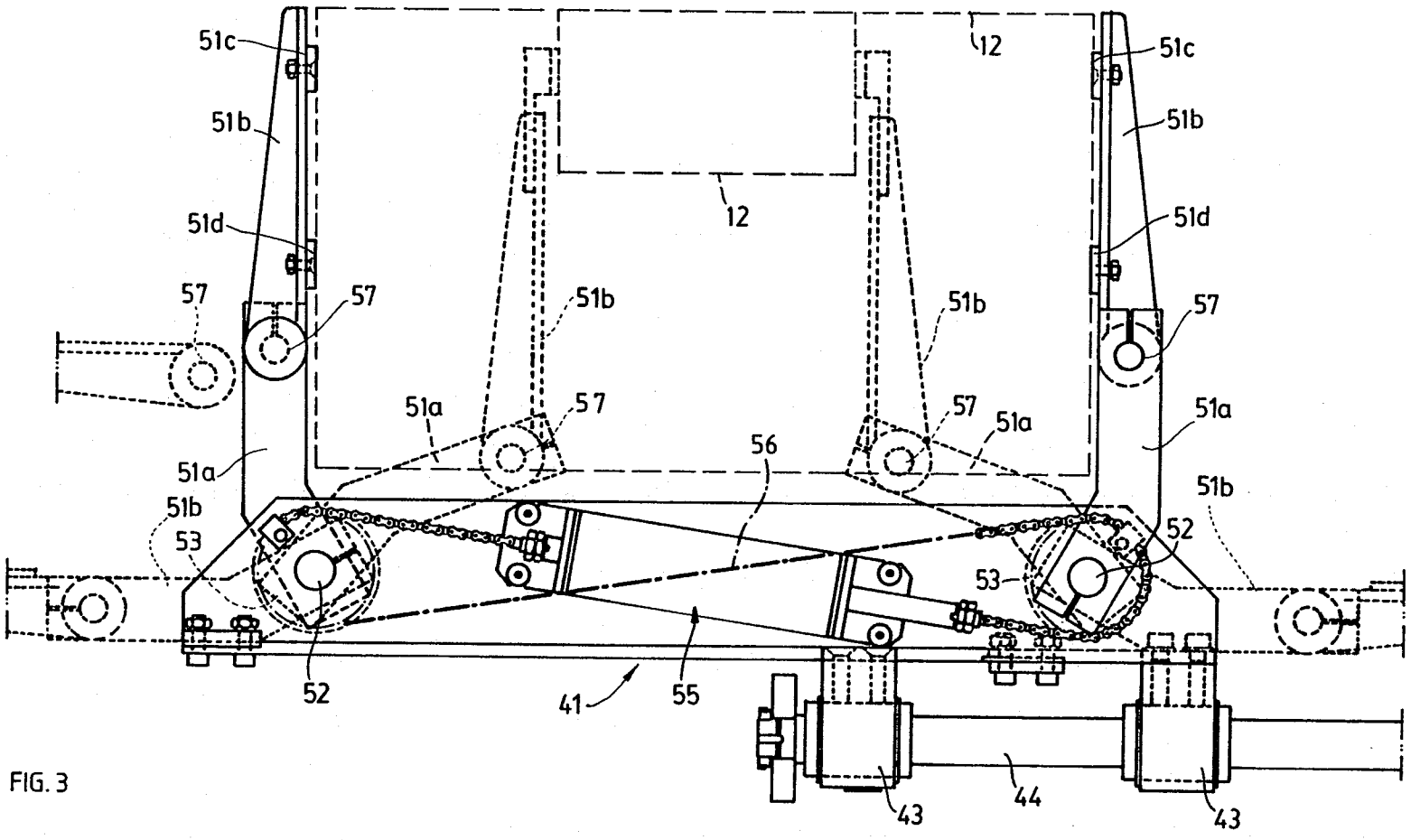
FIG. 3 is a plan view of the stack-conveying slide as formed by the stacker shown in FIG. 1.
Figure 7:
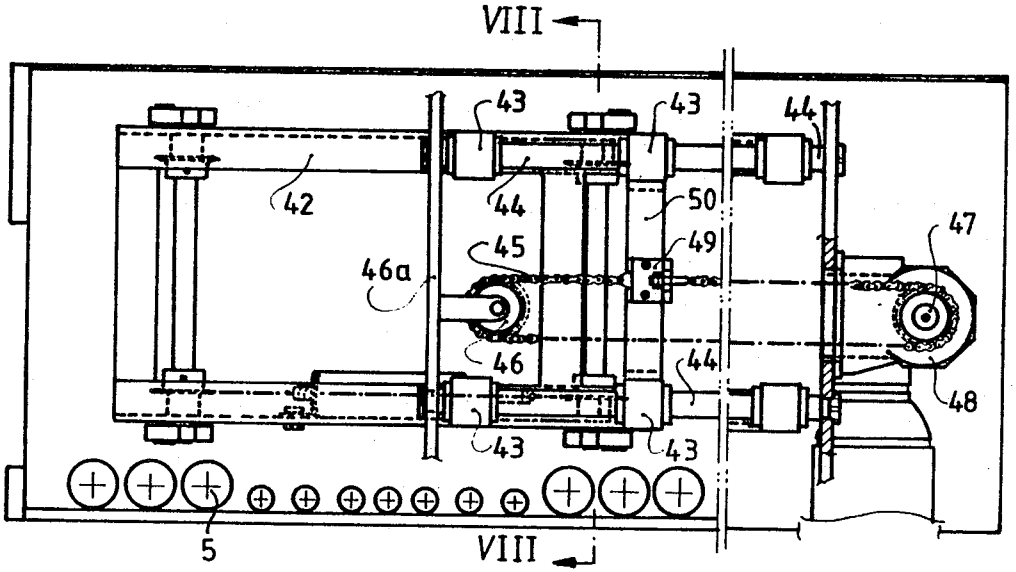
FIG. 7 is a front view of the stack-conveying slide and of the guides thereof, according to the arrow A shown in FIG. 1.
Figure 8:
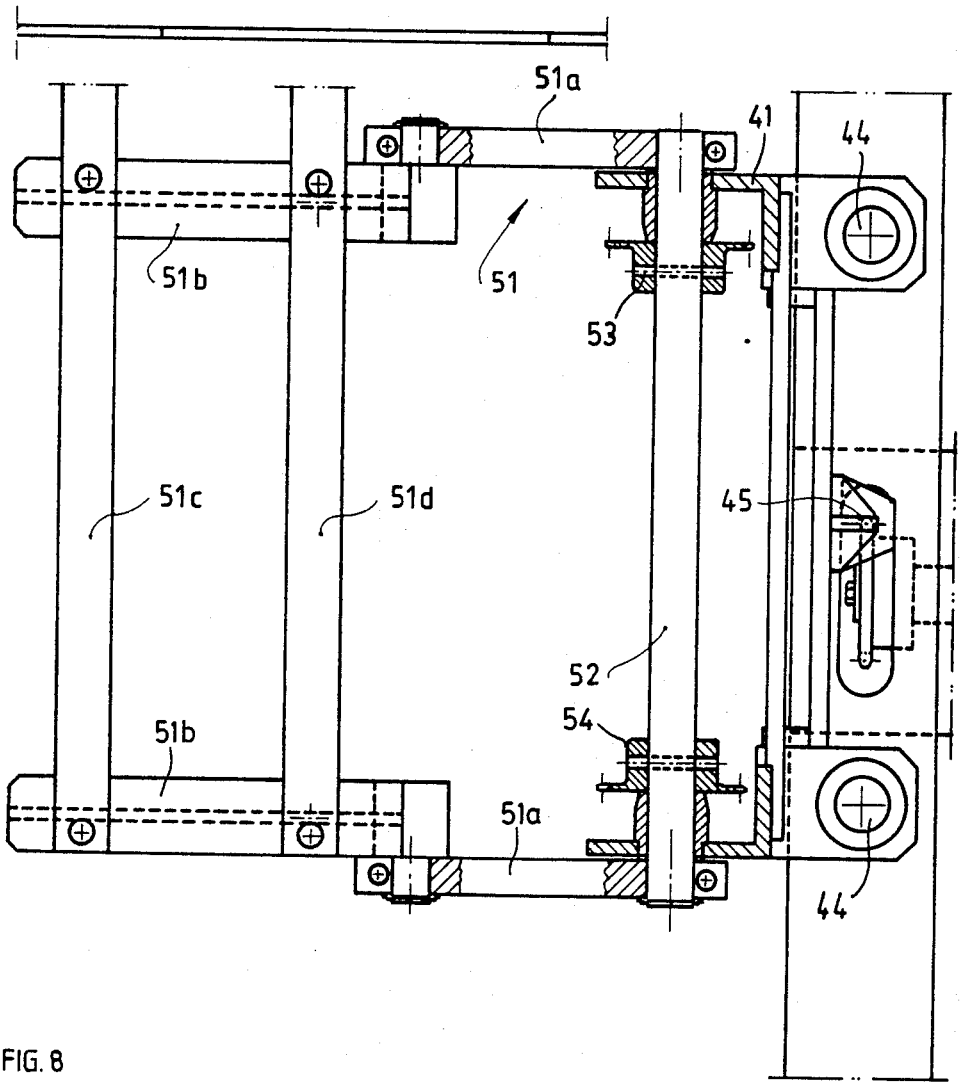
FIG. 8 is a cross section taken along line VIII—VIII of FIG. 7.

With reference to the above-listed Figures which relate to different scales and in which each member is identified through a specific reference number, a conventional stacker with a stack-conveying roller track is indicated, as a whole, at 1. The stacker includes a conventional swing plate (not shown), a bottom truck fork (not shown), a raking roller board 4 and a conveying roller track 5. The stacking shaft is referred to as 6, while the pressing station is marked 7 and the cylinder-pressing ram units are marked 8. The framework supporting stacker 1 is referred to generically with 9. The device according to the invention comprises, essentially, a storage box 10 housing the endboards 11 which are to be placed at the ends of the stacks marked 12. Said storage box 10 is designed as an integral part of framework 9 of stacker 1 and consists of a mobile wall 13 and a guiding or shaped wall 14 placed opposite said mobile wall 13, the lower portion of which is provided with a slit 15 through which a respective endboard 11 is delivered. The bottom plate 16 of storage box 10 features a slot 17, produced in the median area of said bottom plate. Said storage box 10 is connected to a charging unit 18 of said endboards 11, comprising essentially a plate cursor 19 moving to-and-fro on the bottom of said storage box 10. Such motion is obtained by fixing the plate 19 to the mobile member 20 or outer cursor of a driving cylinder/ram unit 21, which is rigidly connected to the storage box 10 by means of end connectors marked 22. In order to reduce its overall dimensions, the cylinder/ram unit 21 is desirably conceived as a pneumatic so-called shaftless unit, namely of the type featuring an outer cursor shifted by means of an inner magnetic cursor, which is in turn shifted by the compressed air used to operate the unit. Such units are known already, and therefore, shall not be described in greater detail hereinafter. The screws connecting the plate cursor 19 to said outer cursor 20 are marked 24. Said outer cursor is provided with suitable members 25 designed to vary the position of the above outer cursor 20 with respect to the cylinder/ram unit 21, so that strokes of varying lengths may be obtained with plate cursor 19, depending on the size of the endboards 11, while using one and the same cylinder-ram unit 21. Said stroke-varying members 25 comprise, in this particular instance, a threaded bar 26 carrying at one end a control wheel 27, the ends of said freely-revolving though axially stationary bar 26 being supported by plates 28 and 29 respectively, one such plate (28) being fixed to the bottom wall 16 of the storage box 10 and the other (29) to the aforementioned outer cursor 20. The plate 29 is furthermore connected with a casing 30, which may consist of two portions as in this illustration, housing a stationary core 31 acting as a nut screw, said threaded bar 26 running across said nut screw. The rotation of control wheel 27 results in the traverse of core 31 and, therefore, of the outer cursor 20 of the cylinder/ram unit 21, thus adjusting the stroke of said outer cursor 20 and, consequently, of the plate cursor 19. Thus, as is readily apparent from the drawing relating to the endboards 11 of the largest commercial size, when the plate cursor 19 is at rest (this position being marked with dotted lines), it is housed in the storage box 10, while in its delivery stop position (as marked with the dotted line shown in FIG. 4) said plate cursor 19 is entirely removed from the storage box 10. In the latter position, said plate cursor causes the ejection of the endboard 11 from the storage box 10, endboard delivery being effected symmetrically with respect to the centre line B of the stacking shaft 6. Where the endboards 11 are smaller in size, said endboards shall be correctly positioned between the guiding front wall 14, comprising a raking upper sector 14*a* designed to pre-align said endboards, and the mobile rear wall 13. In the example under consideration, the latter is provided with a median projecting lug 32, designed to house the freely-revolving clear end of a threaded rod 33, which in turn engages a control wheel 34, the latter being free to rotate within a box-shaped casing 35 fixed to a stationary rear wall 36 of the storage box 10 and housing the aforementioned median nut-screw projecting lug 32. The rotation of control wheel 34 results, therefore, in the translation of the threaded rod 33, which in turn shifts the mobile wall 13. Both said mobile wall 13 and the stationary wall 36 feature in their lower portion a slit, 13*a* and 36*a* respectively, which defines a clearance for the passage of the plate cursor 19. In FIG. 6, number 37 refers to a supporting device specially designed to fix the storage box 10 to the framework 9 of the stacker 1, the possibility of transverse traversing of said storage box with respect to the stacker being provided. Said storage box is fixed to said framework by means of a screwed plate 38 housing a profiled bar 39 engaging, in this particular illustration, two brackets 40, which are designed as integral members of the bottom plate 16 of the storage box 10. The device according to the invention further comprises a stack-conveying slide 41, consisting essentially of a pod-mounted frame 42 resting, by means of tubular supports 43, on two supporting and sliding bars 44, which are fixed to the framework 9 of the stacker in a parallel position with respect to the raking roller board 4. Translation is effected by means of a chain drive 45 engaging two sprocket wheels 46 and 47, the former, 46, being supported as a freely-revolving member by a crosspiece 46*a* fixed to the ends of said supporting bars 44 and the latter, 47, being connected to a geared motor 48 and resting on the framework 9 of the stacker. Said chain 45 is linked, by means of a connecting plate 49, to a crosspiece 50 joining the two innermost tubular supports 43. Thus, the geared motor 48 may drive the slide 41 from the stacking shaft position 6, indicated in FIG. 2, to the opposite limit stop position, where the binding station is located, as indicated in FIG. 2, and back. Two structurally similar side panels 51 are hinged onto said slide 41. Such hinging is effected by means of a shaft 52, two sprocket wheels, 53 and 54 respectively, being keyed onto the upper and lower portions thereof. As shown in FIG. 3, the two upper wheels 53 are connected to the lower wheels 54 by means of a crossed chain drive, marked 55, comprising a single cylinder/-ram driving unit 56. The operation of said unit 56 results, as for the upper wheels, in the rotation of said side panels in one direction and, as regards the lower wheels, in the rotation of the side panels in the opposite direction, namely in the opening and closing directions respectively, as referred to with the continuous line and the dotted line in FIG. 3. The side panels 51 are articulated, or adjustable, so as to enable signatures produced in varying sizes to be conveyed effectively, the dotted line referring to the position required for the proper conveyance of narrower signatures than the ones conveyed with the side panels standing in the position marked with the continuous line. Said articulations, marked 57, may be designed in any desired manner. In this particular example, the design feature a slotted end with a setscrew fitted in the desired angled position between the respective portions 51*a* and 51*b* of each side panel 51. In the example herein referred to, the above consists of two transverse, parallel strips with two vertical strips 51*c* and 51*d* joining portions 51*b*, as shown in FIG. 8. After this description of the structure and mechanisms of the components defining the device according to the invention, let us briefly summarize the steps involved in the fully automated operating cycle of same.

Stack completion is determined by known means. This is followed by the closure of the hitherto open side panels 51, slide 41 being placed in the stacking-shaft position. Hence the stack is delivered and placed onto the conveyance roller track 5, the stack itself being supported laterally by said side panels 51. In its last downward conveyance section, the stack operates a photoelectric cell, which in turn operates the charging unit 18, whereby the plate cursor 19 is shifted into the storage box 10, resulting in the ejection of an endboard 11. As the stack reaches said roller track 5, it starts the conveyor motor 48, whereby the stack is conveyed into the binding station 7. A conveyance limit switch, e.g. a microswitch, is provided, whereby the pistons of the pressing cylinder/ram units 8 are lowered so as to reach a point where their respective ends rest against the endboard 11 placed at the top of the stack. In the meantime, the presence of the stack in the binding station is determined by a photoelectric cell, which readily drives the stacker truck fork back to its raised position: thus an endboard 11 has been placed onto said fork by the charging unit 18. Meanwhile the signatures are being placed onto the plate so as to form the initial part of the stack. Side panels 51 are opened while the active ends of the pressing cylinder/ram units 8 are resting on the stack, which therefore will neither fall apart nor hollow out in any undesired way. Thus slide 41 is driven back to the stacking shaft while the aforementioned side supporting rollers are lifted out of the roller board, said rollers offering sufficient mechanical strength during stack compression. Compression is followed by stack binding, after which said positioning rollers are replaced and the rams of the pressing unit 8 are retracted to their initial position.

This leads us back to the position described at the beginning of the operating cycle.

No detailed description of the relevant circuits and control units is provided, as those are readily accessible and may be freely selected in accordance with the technician's specific requirements. From the above description, it is readily apparent that the device according to the invention is effective in achieving the objects and advantages referred to hereinabove. Operations which have hitherto been performed manually by an operator, can now be performed through a fully automatic cycle and, more specifically, through the use of a single charger, whereby stacks of signatures of all sizes can be produced. The side panels of the slide or trollery are both light and simple in construction, and are furthermore designed to supply a reaction thrust in the region of e.g. 8–10 kgs. The reaction thrust required in order to withstand the considerable pressure exerted during compression, e.g. 600 kgs, is provided by conventional rocking aligner rolls, their resistance ranging from 30 to 50 kgs. A limited number of components is required for the construction of the side panels and of the relevant supporting slide, said components being furthermore easy to manufacture and functionally reliable.

All of the individual parts may be replced by other technically and/or functionally equivalent ones without exceeding the scope of this inventive concept.

The dimensions, materials, and supporting members used, may also be selected in accordance with one's specific requirements. All of the features referred to in the description, claims and drawings are to be considered substantial to this invention, both singly and in any combination thereof.

I claim:

1. An arrangement for handling stacks of sheets, comprising:

(A) a stack-forming station and a stack-binding station spaced apart from each other along a longitudinal direction;

(B) an endboard hopper for containing endboards having widths, as considered along the longitudinal direction;

(C) feed means for feeding a bottom endboard from the endboard hopper along a feed path to the stack-forming station;

(D) means for stacking a plurality of sheets one above another onto the bottom endboard in the stack-forming station to form a stack with sheets having widths, as considered along the longitudinal direction, substantially the same as the widths of the endboards;

(E) said feed means being further operative for feeding a top endboard from the endboard hopper along the feed path onto the stack in the stack-forming station;

(F) means for adjusting the length of the feed path to accommodate endboards of different widths;

(G) means for longitudinally conveying the stack and the bottom and top endboards from the stack-forming station along a travel path to the stack-binding station; and (H) means for holding opposite sides of the stack during conveyance along the travel path, including:

(i) a pair of articulated side arms, each having an outer gripping member pivotably connected to an inner member, and (ii) drive means for moving the side arms from a non-gripping position remote from the stack to a desired one of a plurality of gripping positions in which the outer gripping members are positioned generally parallel to each other and are spaced longitudinally apart by a spacing corresponding to the widths of the sheets, whereby stacks of sheets of different widths are accommodated.

2. The arrangement of claim 1, wherein the hopper includes a stationary wall at one side of the endboards, a movable wall at an opposite side of the endboards, and means for adjustably displacing the movable wall toward the stationary wall to accommodate endboards of different widths.

3. The arrangement of claim 2, wherein the displacing means includes a handwheel threadedly connected to a threaded rod having one end connected to the movable wall.

4. The arrangement of claim 1, wherein the feed means includes a longitudinally-reciprocatable cursor movable underneath the hopper, and wherein the means for adjusting the feed path length includes a control wheel threadedly connected to a threaded bar having one end connected to the cursor.

5. The arrangement of claim 1, wherein the side arms include a pair of upper arms, a pair of lower arms, and cross-arms interconnecting a respective upper arm to a respective lower arm at each side of the stack.

6. The arrangement of claim 5, wherein the drive means includes a pair of upper sprocket wheels mounted for joint turning movement with the upper arms; a pair of lower sprocket wheels mounted for joint turning movement with the lower arms; and a cross-chain drive including an upper chain entrained about the upper sprocket wheels, a lower chain entrained about the lower sprocket wheels, each chain having the configuration of the numeral "8", and a single drive unit operatively connected to the upper chain for turning the upper wheels in opposite circumferential directions and, in turn, the side arms toward and away from each other.

7. The arrangement of claim 6, wherein each inner member of each arm is mounted for joint turning movement with a respective sprocket wheel.

* * * * *